US011448435B2

(12) United States Patent
Kaneko et al.

(10) Patent No.: US 11,448,435 B2
(45) Date of Patent: Sep. 20, 2022

(54) EVAPORATOR AND REFRIGERATION SYSTEM

(71) Applicant: MITSUBISHI HEAVY INDUSTRIES THERMAL SYSTEMS, LTD., Tokyo (JP)

(72) Inventors: Takeshi Kaneko, Tokyo (JP); Taichi Yoshii, Tokyo (JP); Naoya Miyoshi, Tokyo (JP); Yasushi Hasegawa, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 172 days.

(21) Appl. No.: 16/756,027

(22) PCT Filed: Oct. 11, 2018

(86) PCT No.: PCT/JP2018/037934

§ 371 (c)(1),
(2) Date: Apr. 14, 2020

(87) PCT Pub. No.: WO2019/078084

PCT Pub. Date: Apr. 25, 2019

(65) Prior Publication Data

US 2020/0309424 A1 Oct. 1, 2020

(30) Foreign Application Priority Data

Oct. 17, 2017 (JP) ..... JP2017-201077

(51) Int. Cl.
*F25B 39/02* (2006.01)
*F28D 7/16* (2006.01)

(52) U.S. Cl.
CPC ..... *F25B 39/02* (2013.01); *F28D 7/16* (2013.01)

(58) Field of Classification Search
CPC ..... F25B 39/02; F25B 39/028; F28D 7/16
(Continued)

(56) References Cited

U.S. PATENT DOCUMENTS 2,059,725 A * 11/1936 Carrier ..... F25B 39/02 62/394
3,412,569 A * 11/1968 Arledge, Jr. ..... F25B 39/02 62/115

(Continued)

FOREIGN PATENT DOCUMENTS

CN 2274322 Y 2/1998
CN 2441094 Y 8/2001

(Continued)

OTHER PUBLICATIONS

International Search Report for International Application No. PCT/JP2018/037934, dated Jan. 8, 2019, with English translation.

(Continued)

*Primary Examiner* — Tho V Duong
*Assistant Examiner* — Raheena R Malik
(74) *Attorney, Agent, or Firm* — Birch, Stewart, Kolasch & Birch, LLP

(57) ABSTRACT

An evaporator (2) comprising: a casing (5); a plurality of heat transfer tubes (12) which are immersed in a liquid refrigerant (RL) in a liquid-phase region (A1) and in the interior of which a fluid having a higher temperature than that of the liquid refrigerant (RL) flows; and a demister (7) which is provided so as to cover from above the liquid surface (Ls) of the liquid refrigerant (RL) accommodated in the liquid-phase region (A1), and which traps liquid droplets contained in evaporated gas refrigerant (RG). The demister (7) comprises inclined sections (13) which, when viewed in a cross section intersecting the axial line (O2) of the heat transfer tubes (12), separate from the liquid surface (Ls)

(Continued)

toward the center portion of the casing (5) along the liquid surface (Ls).

5 Claims, 6 Drawing Sheets

(58) Field of Classification Search
USPC ..... 62/527, 515
See application file for complete search history.

(56) References Cited

U.S. PATENT DOCUMENTS

| | | | | |
|---|---|---|---|---|
| 6,868,695 | B1 * | 3/2005 | Dingel | F25B 39/028 165/115 |
| 6,910,349 | B2 * | 6/2005 | Bodell, II | F04D 27/0253 62/515 |
| 7,421,855 | B2 * | 9/2008 | Ring | F28F 9/0265 62/525 |
| 8,944,152 | B2 * | 2/2015 | Kulankara | F28D 21/0017 165/115 |
| 9,366,464 | B2 * | 6/2016 | Sonninen | F25B 43/00 |
| 2013/0277020 | A1 | 10/2013 | Numata et al. | |
| 2017/0153049 | A1 | 6/2017 | Kondo et al. | |

FOREIGN PATENT DOCUMENTS

| | | | | |
|---|---|---|---|---|
| CN | 102259941 | A | | 11/2011 |
| CN | 202328928 | U | | 7/2012 |
| CN | 202328957 | U | * | 7/2012 |
| CN | 203908141 | U | | 10/2014 |
| JP | 43-3480 | B | | 2/1968 |
| JP | 45-28350 | B | | 9/1970 |
| JP | 48-89042 | U | | 10/1973 |
| JP | 50-134064 | U | | 11/1975 |
| JP | 51-5759 | U | | 1/1976 |
| JP | 54-120753 | U | | 8/1979 |
| JP | 57-179596 | A | | 11/1982 |
| JP | 58-183471 | U | | 12/1983 |
| JP | 2001-355994 | A | | 12/2001 |
| JP | 2002-333236 | A | | 11/2002 |
| JP | 2002-340444 | A | | 11/2002 |
| JP | 2004-100985 | A | | 4/2004 |
| JP | 2004100985 | A | * | 4/2004 |
| JP | 2004-340546 | A | | 12/2004 |
| JP | 2008-138891 | A | | 6/2008 |
| JP | 2015-518132 | A | | 6/2015 |
| JP | 2016-65676 | A | | 4/2016 |

OTHER PUBLICATIONS

Written Opinion of the International Searching Authority for International Application No. PCT/JP2018/037934, dated Jan. 8, 2019, with English translation.

* cited by examiner

EVAPORATOR AND REFRIGERATION SYSTEM

TECHNICAL FIELD

The present invention relates to an evaporator and a refrigeration system.

Priority is claimed on Japanese Patent Application No. 2017-201077, filed on Oct. 17, 2017, the content of which is incorporated herein by reference.

BACKGROUND ART

As an evaporator of a refrigeration system such as a refrigeration chiller, a flooded evaporator is known in which a heat transfer tube is immersed in a liquid refrigerant.

PTL 1 discloses a technique as follows. In the evaporator as described above, a droplet may be contained in a gas refrigerant obtained after a liquid refrigerant evaporates in some cases. Accordingly, a space between a suction pipe and a liquid surface is vertically partitioned, and a demister for collecting the droplet is disposed to prevent a carryover phenomenon that the droplet flows into a compressor disposed in a rear stage of the evaporator.

CITATION LIST

Patent Literature

[PTL 1] Japanese Unexamined Patent Application Publication No. 2002-340444

SUMMARY OF INVENTION

Technical Problem

Incidentally, the above-described evaporator needs to be further downsized. However, in a case where only the evaporator is downsized while a heat exchange of the evaporator is maintained, or in a case where the heat exchange amount is increased without changing the size of the evaporator, an area of the demister relatively decreases, compared to the heat exchange amount. In this case, a gas passing speed of the demister increases, and a collected amount of the droplets per unit area of the demister increases. Then, if a gas passing rate or a collection load of the demister exceeds an upper limit value, it is assumed that the carryover phenomenon occurs since the droplets are scattered from the demister toward the compressor side.

The present invention has been made in view of the above circumstances, and provides an evaporator and a refrigeration system that can be downsized or can increase the heat exchange amount while preventing a carryover phenomenon.

Solution to Problem

In order to solve the above-described problem, the following configurations are adopted.

According to a first aspect of the present invention, there is provided an evaporator including a casing that internally has a liquid phase region for accommodating a liquid refrigerant and a gas phase region for accommodating a gas refrigerant obtained after the liquid refrigerant evaporates, and that includes an evaporator outlet for discharging the gas refrigerant to the gas phase region, a plurality of heat transfer tubes that are immersed in the liquid refrigerant of the liquid phase region, and into which a fluid having a temperature higher than that of the liquid refrigerant flows, and a demister that is disposed to cover a liquid surface of the liquid refrigerant accommodated in the liquid phase region from above, and that collects a droplet contained in the evaporated gas refrigerant. The demister includes an inclined portion that separates from the liquid surface toward a central portion of the casing along the liquid surface, in a sectional view intersecting an axis of the heat transfer tube.

According to this configuration, compared to a case where the demister is disposed to be flat along the liquid surface, an area of the demister can be increased. Therefore, compared to the case where the demister is disposed to be flat along the liquid surface, it is possible to increase an upper limit value of a gas passing rate or a collection load of the demister.

Furthermore, the demister separates from the liquid surface toward the central portion of the casing by the inclined portion. Accordingly, it is possible to prevent the demister from sinking into the liquid refrigerant due to a rise of a froth level generated in the vicinity of the central portion of the casing. Therefore, it is possible to prevent the droplet from being scattered from an outlet side of the demister.

Accordingly, downsizing or an increase in a heat exchange amount can be achieved while preventing a carryover phenomenon.

According to a second aspect of the present invention, the casing according to the first aspect may include a support portion that supports an end edge of the demister on a side close to the liquid surface from below. The support portion may include a penetrating portion that vertically penetrates a portion between the end edge and an inner surface of the casing, in the sectional view intersecting the axis of the heat transfer tube.

According to this configuration, the droplet collected by the demister reaches the end edge along the inclined portion due to its own weight. Then, the droplet reaching the end edge can be dropped on the liquid phase region through the penetrating portion.

According to a third aspect of the present invention, the evaporator according to the first or second aspect may include a blowing-up prevention plate that is formed along the demister, in the sectional view intersecting the axis of the heat transfer tube, and that is disposed at a position overlapping the evaporator outlet in a direction of the axis.

According to this configuration, the blowing-up prevention plate is disposed at the position overlapping the evaporator outlet in the direction of the axis. In this manner, the gas refrigerant passing through the demister disposed at the position overlapping the evaporator outlet in the direction of the axis reaches the evaporator outlet after bypassing the blowing-up prevention plate. Therefore, it is possible to prevent the droplet collected in demister disposed at the position overlapping the evaporator outlet from being suctioned into the evaporator outlet. Furthermore, the blowing-up prevention plate is formed along the demister. Accordingly, a gap can be sufficiently secured between the demister and the blowing-up prevention plate. Therefore, the gas refrigerant can have a uniform flow rate between the demister and the blowing-up prevention plate. In addition, in a case where the droplet adheres onto the blowing-up prevention plate, as in the droplet collected by the demister, the droplet can be dropped due to its own weight, and can be moved from directly below the evaporator outlet by using the inclination of the blowing-up prevention plate. Therefore, it is possible to further prevent the droplet from being suctioned into the evaporator outlet.

According to a fourth aspect of the present invention, in the evaporator according to any one of the first to third aspects, in the sectional view intersecting the axis of the heat transfer tube, the number of the heat transfer tubes aligned in a direction intersecting the liquid surface which are located at a position close to the central portion is larger than the number of heat transfer tubes which are located at a position close to an end portion of the casing in a spreading direction of the liquid surface.

According to this configuration, it is possible to prevent the froth level from rising at the position close to the end portion of the casing. Therefore, it is possible to prevent the end portion of the demister from sinking into the liquid refrigerant due to the rise of the froth level.

According to a fifth aspect of the present invention, there is provided a refrigeration system including the evaporator according to any one aspect of the first to fourth aspects.

According to this configuration, the evaporator can be downsized without reducing the heat exchange amount of the evaporator. In addition, the heat exchange amount can be increased while a size of the evaporator is maintained. Therefore, it is possible to improve productivity of the refrigeration system.

Advantageous Effects of Invention

According to the evaporator and the refrigeration system, downsizing or an increase in a heat exchange amount can be achieved while preventing a carryover phenomenon.

DESCRIPTION OF EMBODIMENTS

First Embodiment

Next, an evaporator and a refrigeration system according to a first embodiment of the present invention will be described with reference to the drawings.

Figure 1:
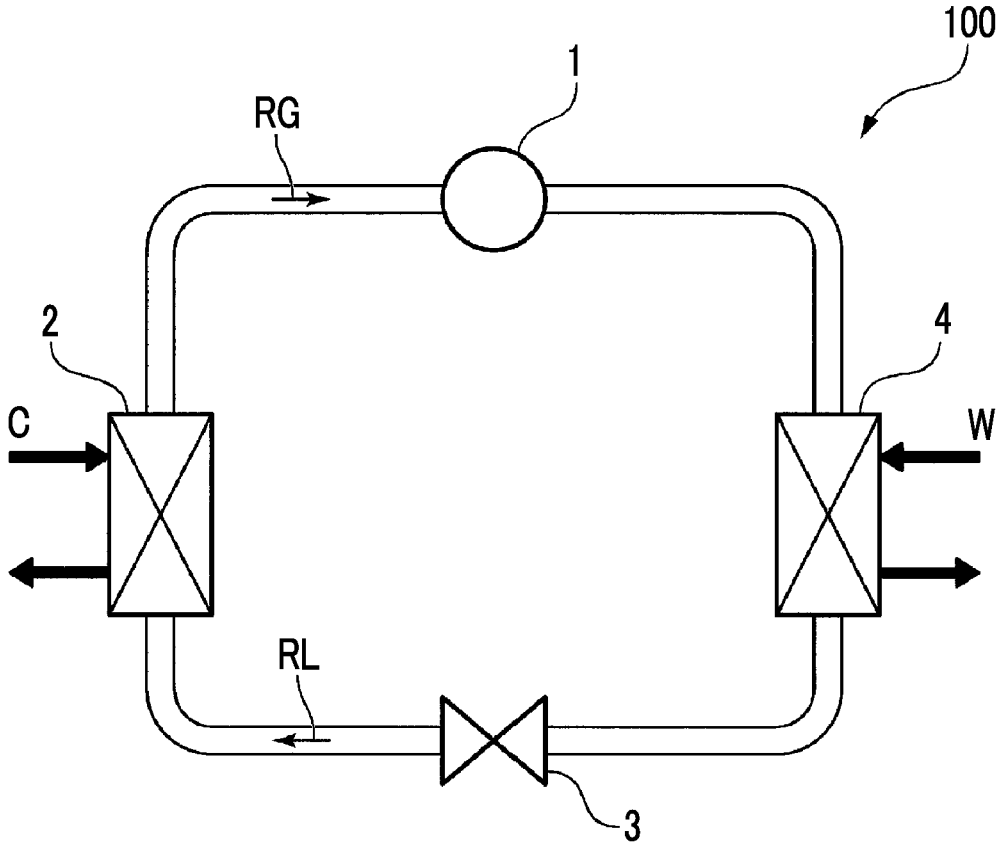
FIG. 1 is a configuration diagram illustrating a schematic configuration of a refrigeration system according to a first embodiment.

FIG. 1 is a configuration diagram illustrating a schematic configuration of the refrigeration system according to the first embodiment. The refrigeration system as an example to be described in the first embodiment is a so-called vapor compression type centrifugal chiller.

As illustrated in FIG. 1, a refrigeration system 100 according to the first embodiment has a heat pump cycle (refrigerating cycle), and includes a turbo compressor 1, an evaporator 2, an expansion valve 3, and a condenser 4.

In the heat pump cycle of the refrigeration system 100, a high-pressure gas refrigerant compressed by the turbo compressor 1 is condensed after exchanging heat with the cooling water W supplied from outside by the condenser 4. The condensed liquid refrigerant flows into the evaporator 2 after being expanded and cooled by the expansion valve 3. A liquid refrigerant RL flowing into the evaporator 2 evaporates after exchanging heat with a cooling target fluid C having a temperature higher than that of the liquid refrigerant RL. Then, an evaporated gas refrigerant RG returns to the turbo compressor 1. The heat pump cycle of the refrigeration system 100 is not limited to a basic configuration described here.

Figure 2:
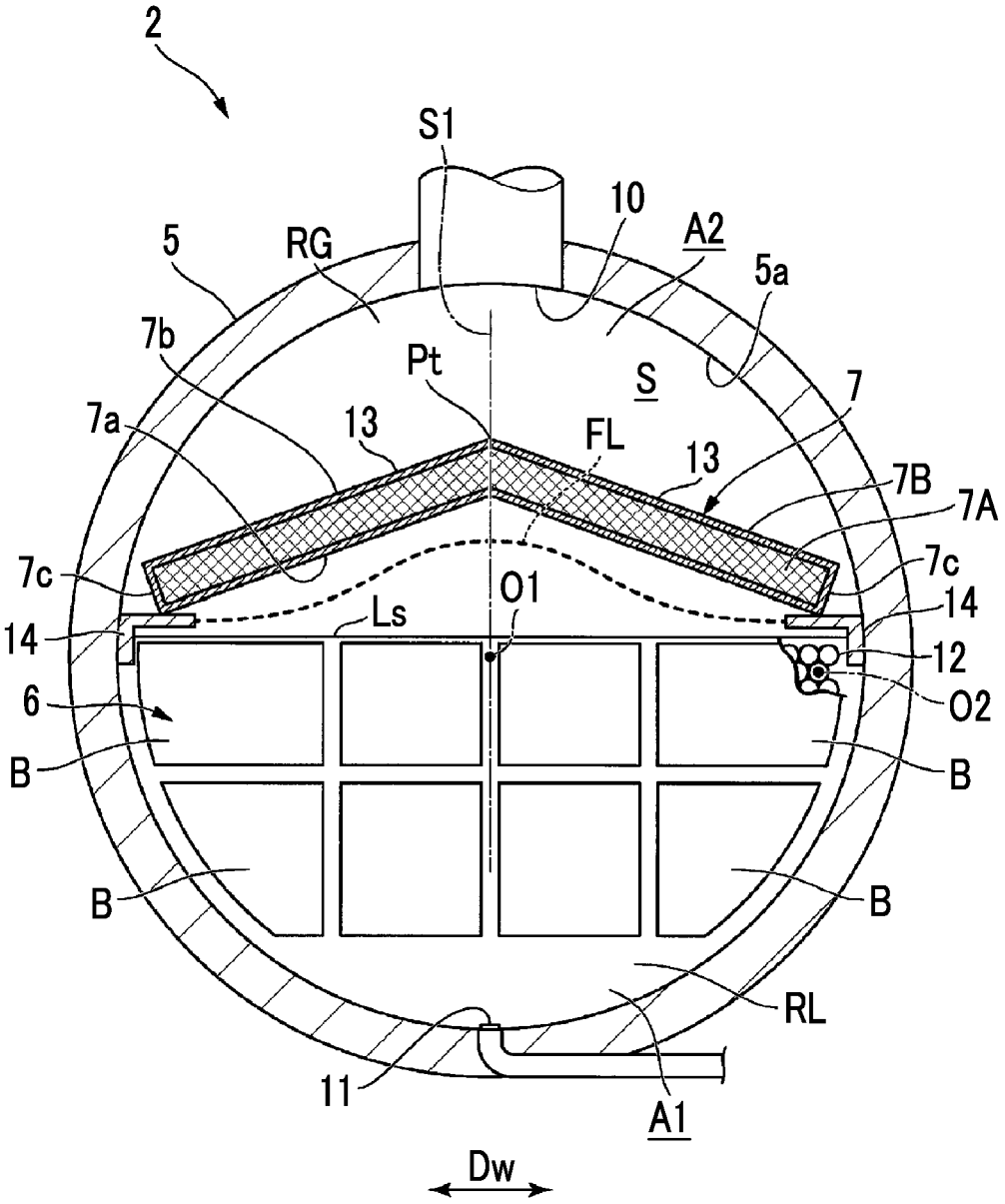
FIG. 2 is a sectional view of an evaporator according to the first embodiment of the present invention.
Figure 3:
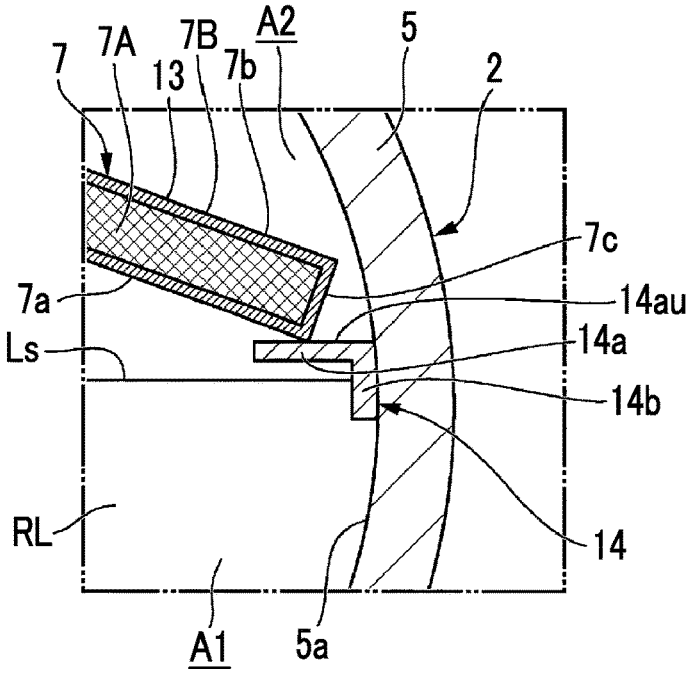
FIG. 3 is an enlarged view of a support portion according to the first embodiment of the present invention.

FIG. 2 is a sectional view of the evaporator according to the first embodiment of the present invention. FIG. 3 is an enlarged view of a support portion according to the first embodiment of the present invention.

As illustrated in FIG. 2, the evaporator 2 includes a casing 5, a heat transfer tube bundle 6, and a demister 7.

The casing 5 forms a sealed internal space S that covers the heat transfer tube bundle 6 and the demister 7. The liquid refrigerant RL can be stored in the internal space S of the casing 5. The casing 5 has an evaporator outlet 10 that discharges the evaporated gas refrigerant RG outward to be delivered toward the turbo compressor 1, and an evaporator inlet 11 for causing an external pipe for supplying the liquid refrigerant RL to communicate with the internal space S. For example, the casing 5 described as an example in the first embodiment is a pressure container having an annular contour in cross section. In addition to the above-described configuration, the casing 5 also has an opening portion (not illustrated) for causing an external pipe (not illustrated) for supplying the cooling target fluid C to communicate with a heat transfer tube 12 (heat transfer tube bundle 6).

The heat transfer tube bundle 6 includes a plurality of the heat transfer tubes 12 into which the cooling target fluid C flows. The heat transfer tube bundle 6 is disposed mainly in a lower portion in the internal space S of the casing 5. The plurality of heat transfer tubes 12 extend in a longitudinal direction (in a forward-rearward direction in the drawing of FIG. 2: in other words, a direction of an axis O1 of the casings 5) of the casings 5, each contour in cross section of which is formed in an annular shape. The heat transfer tube bundles 6 are disposed in a liquid phase region A1 below a liquid surface Ls of the liquid refrigerant RL collected in a lower portion of the internal space S inside the casing 5. In other words, the heat transfer tube 12 is immersed in the liquid refrigerant RL. A case where the liquid surface Ls according to the present embodiment is located slightly above the axis O1 of the casing 5 has been described as an example. However, a position of the liquid surface Ls is not limited to the above-described position.

The heat transfer tube bundle 6 is divided into a plurality of blocks B in a direction orthogonal to the axis O1 of the casing 5 (hereinafter, simply referred to as a width direction Dw of the casing 5). In a sectional view illustrated in FIG. 2, each of the plurality of blocks B has a rectangular shape or a shape close to a rectangular shape in which some sides of the rectangular shape are replaced with protruding curved surfaces. The blocks B are arranged in the width direction Dw with a slight gap therebetween. Multiple heat transfer tubes 12 are disposed inside each block B of the heat transfer tube bundle 6 described as an example in the present embodiment. The multiple heat transfer tubes 12 are disposed at a predetermined interval inside the block B so that a distance between the adjacent heat transfer tubes 12 is a substantially equal interval. Referring to FIG. 2, a case where the blocks B are vertically disposed in two stages has been described as an example. However, only one stage may be adopted, or three or more stages may be adopted.

The demister 7 collects a droplet (liquid refrigerant RL) contained in the evaporated gas refrigerant RG. The demister 7 is accommodated in the gas phase region A2 above the liquid surface Ls in the internal space S, and is disposed to cover the liquid surface Ls of the liquid refrigerant RL from above. For example, the demister 7 includes a demister main body 7A formed in a dense wire mesh shape, and a frame 7B that supports the demister main body 7A. The demister main body 7A includes an inlet 7*a* facing the liquid surface Ls and an outlet 7*b* on side opposite to the inlet 7*a*. The demister 7 allows the gas refrigerant RG to pass from the inlet 7*a* toward the outlet 7*b*, and captures the droplet contained in the gas refrigerant RG passing through the demister 7 by bringing the droplet into contact with a metal mesh.

The demister 7 described as an example in the present embodiment includes two inclined portions 13. In a sectional view (refer to FIG. 2) intersecting an axis O2 of the heat transfer tube 12, the inclined portions 13 are respectively formed to separate from the liquid surface Ls toward a central portion (in other words, a side close to the axis O1) of the casing 5 along the liquid surface Ls. In this manner, the demister 7 is disposed above a rise of a froth level FL generated due to boiling of the liquid refrigerant, in the central portion in the width direction Dw. Then, the two inclined portions 13 are connected to each other on a center plane S1 in the width direction Dw including the axis O1. The inclined portions 13 described as an example in the first embodiment are respectively formed in a flat plate shape.

In addition, the two inclined portions 13 are disposed symmetrically, based on the center plane S1. That is, the demister 7 has a mountain shape (in other words, an inverted V-shape) whose vertex position Pt serving as an uppermost portion is disposed on the center plane S1. Here, an inclination angle of the inclined portion 13 based on the liquid surface Ls may be 30 degrees or smaller. In this way, a flow rate of the gas refrigerant RG in an upper portion of the demister 7, that is, in the vicinity of a top can be minimized, and the droplet can be prevented from being scattered toward the evaporator outlet 10 from the outlet 7*b* in the vicinity of the vertex position Pt of the demister 7.

The demister 7 is formed to be located on a side slightly closer to the center plane S1 than the inner surface 5*a* of the casing 5 from the above-described position of the center plane S1 in a spreading direction of the liquid surface Ls in a cross section illustrated in FIG. 2, that is, in the width direction Dw. That is, the demister 7 is not directly in contact with an inner surface 5*a* of the casing 5. In the demister 7, two end edges 7*c* on the side close to the liquid surface Ls are respectively supported by support portions 14. The two end edges 7*c* described as an example in the present embodiment have flat surfaces respectively perpendicular to a surface on the inlet 7*a* side and a surface on the outlet 7*b* side of the demister 7.

As illustrated in FIG. 3, the support portions 14 respectively support the end edges 7*c* of the demister 7 from below. The number of the disposed support portions 14 according to the first embodiment are two, which is the same number as the number of the end edges 7*c*. The support portions 14 include a support portion main body 14*a* and a fixing portion 14*b*. The support portion main body 14*a* extends toward the center plane S1 slightly above the liquid surface Ls on the inner surface 5*a* of the casing 5 and from both side positions in the width direction Dw. The fixing portion 14*b* extends downward from a base portion of the support portion main body 14*a* along the inner surface 5*a*. The support portion 14 described as an example in the present embodiment extends in the direction of the axis O1 of the casing 5 (in other words, the direction of the axis O2 of the heat transfer tube 12), and an upper surface 14*au* thereof is a flat surface spreading in a horizontal direction. In FIG. 3, the heat transfer tube bundle 6 is omitted in the illustration for convenience of illustration (the same applies to FIG. 4 according to a second embodiment).

In the present embodiment, a case where the support portion 14 is formed to have an L-shaped cross section by using the support portion main body 14*a* and the fixing portion 14*b* has been described as an example. However, as long as the demister 7 can be supported from below, the support portion 14 is not limited the above-described shape (hereinafter, the same applies to the second embodiment). In addition, an extending length of the support portion main body 14*a* can be shorter while the length enables the end edge 7*c* to be supported. In this way, it is possible to prevent a flow of the gas refrigerant RG in the internal space S from being hindered by the support portion main body 14*a*.

Therefore, according to the above-described first embodiment, compared to a case where the demister is disposed to be flat along the liquid surface Ls, an area of the demister 7 can be increased. Therefore, compared to the case where the demister is disposed to be flat along the liquid surface Ls, it is possible to increase an upper limit value of a gas passing rate or a collection load of the demister 7.

Furthermore, the demister 7 separates from the liquid surface Ls toward the central portion in the width direction Dw of the casing 5 by the inclined portion 13. Accordingly, the demister 7 can be prevented from sinking into the liquid refrigerant RL due to a rise (illustrated by a broken line in FIG. 2) of the froth level FL generated in the vicinity of the axis O1 of the casing 5. Therefore, the droplet can be prevented from being scattered from the outlet 7*b* side of the demister 7.

As a result, downsizing or an increase in a heat exchange amount can be achieved while preventing a carryover phenomenon that the droplet is drawn into the turbo compressor 1.

Second Embodiment

Next, an evaporator and a refrigeration system according to a second embodiment of the present invention will be described with reference to the drawings. The second embodiment is different from the above-described first embodiment only in a shape of a support portion. Therefore, the same reference numerals will be assigned to elements the same as those according to the first embodiment, and repeated description will be omitted.

Figure 4:
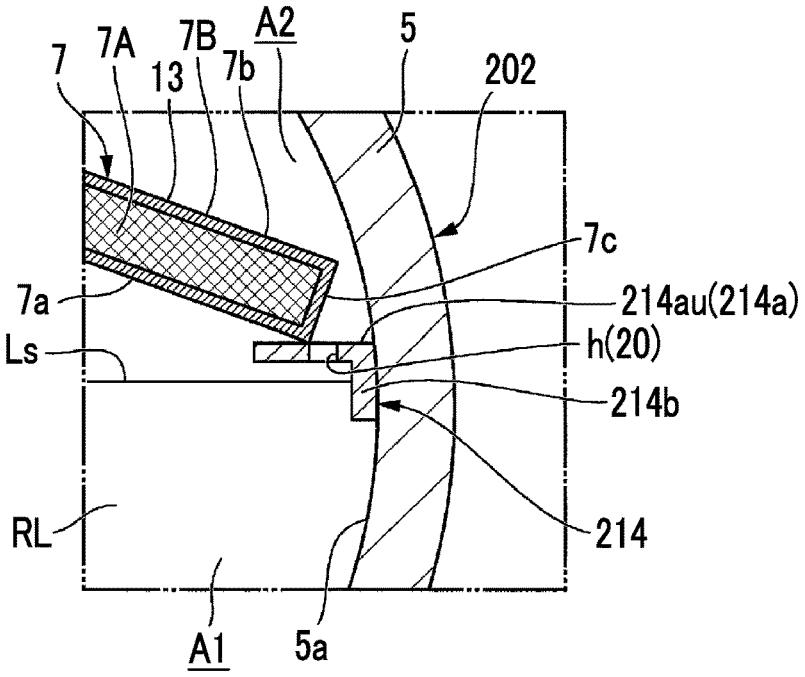
FIG. 4 is a sectional view of a support portion according to a second embodiment of the present invention.

FIG. 4 is a sectional view of the support portion according to the second embodiment of the present invention.

As illustrated in FIG. 4, an evaporator 202 according to the second embodiment includes the casing 5, the heat transfer tube bundle (not illustrated), and the demister 7. The heat transfer tube bundle 6 and the demister 7 have the same configurations as that of the heat transfer tube bundle and the demister 7 according to the above-described first embodiment, and thus, detailed description will be omitted.

A support portion 214 is fixed to the inner surface 5*a* of the casing 5. The support portion 214 supports the end edge 7*c* of the demister 7 from below, as in the support portion 14 according to the first embodiment. The support portion 214 includes a support portion main body 214*a* and a fixing portion 214*b*. The support portion main body 214*a* extends toward the center plane S1 slightly above the liquid surface Ls on the inner surface 5*a* of the casing 5, and from both side positions in the width direction Dw. The fixing portion 214*b* extends downward from the support portion main body 214*a* along the inner surface 5*a*. The support portion 214 described as an example in the second embodiment extends in the direction of the axis O1 of the casing 5 (in other words, the direction of the axis O2 of the heat transfer tube 12), and an upper surface 214*au* thereof is a flat surface spreading in the horizontal direction.

In a sectional view intersecting the axis O2 of the heat transfer tube 12, the support portion 214 includes a penetrating portion 20 having a vertically penetrating hole, at a position between the end edge 7*c* and the inner surface 5*a* of the casing 5 in the width direction Dw. As the vertically penetrating hole, the penetrating portion 20 according to the second embodiment has a plurality of slits h (through-holes) penetrating in a direction perpendicular to the upper surface 214*au* of the support portion main body 214*a*. The plurality of slits h extend in the direction of the axis O1, and are disposed at a predetermined interval in the direction of the axis O1. The slits h extending in the direction of the axis O1 have been described as the penetrating hole. However, the penetrating hole may be a round hole or a long hole.

Therefore, according to the second embodiment, the droplet collected by the demister 7 reaches the end edge 7*c* along the inclined portion 13 due to its own weight. In this case, the droplet reaching the end edge 7*c* can be dropped on the liquid phase region A1 through the slits h.

As a result, the droplets collected by the demister 7 can be returned again to the liquid phase region A1, and can be evaporated by the heat transfer tube bundle 6.

Third Embodiment

Next, a third embodiment of the present invention will be described with reference to the drawings. The third embodiment is different from the above-described first or second embodiment in that a blowing-up prevention plate is disposed therein. Therefore, the same reference numerals will be assigned to elements the same as those according to the above-described first embodiment, and repeated description will be omitted.

Figure 5:
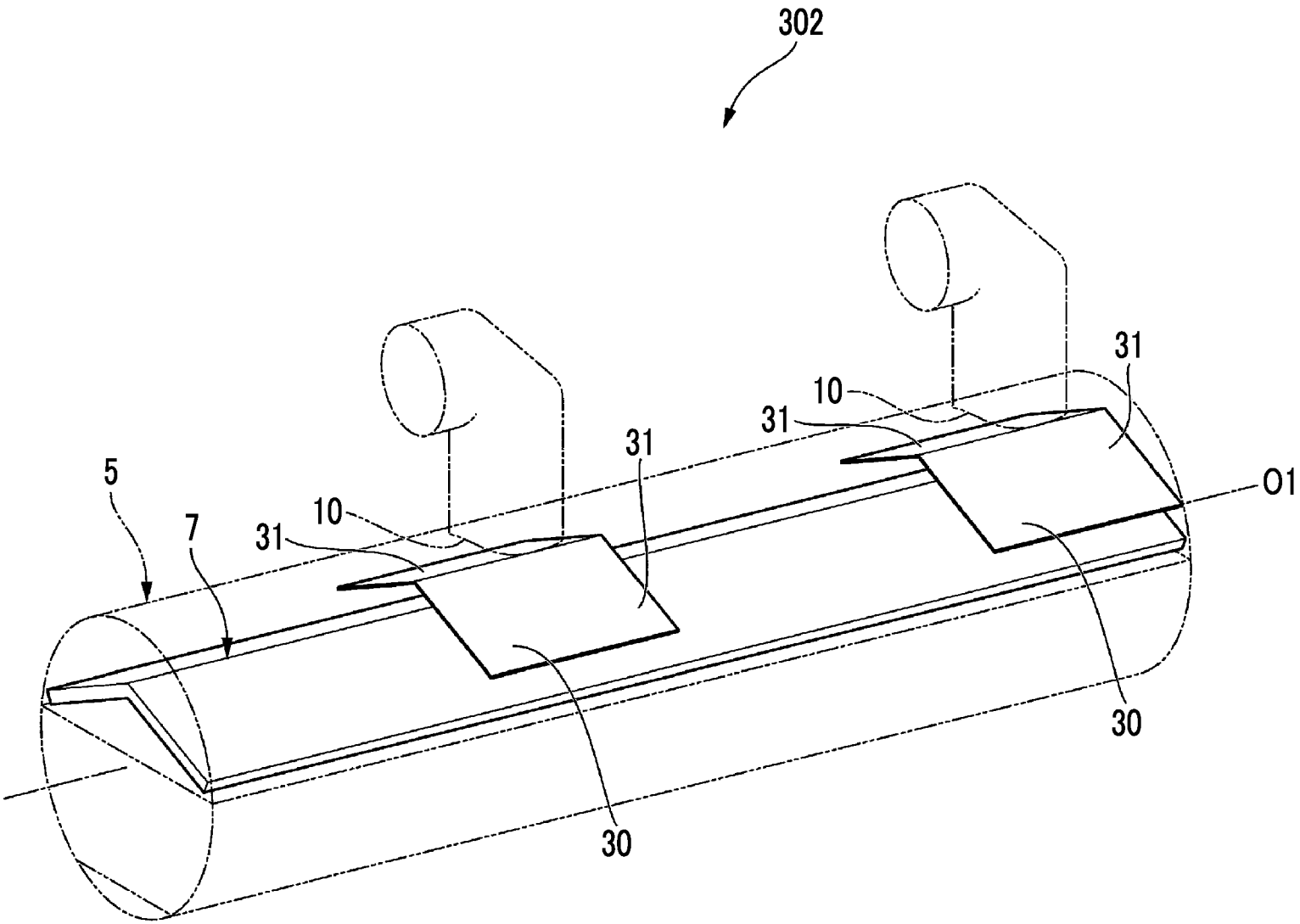
FIG. 5 is a perspective view illustrating an internal structure of a casing of an evaporator according to a third embodiment of the present invention.
Figure 6:
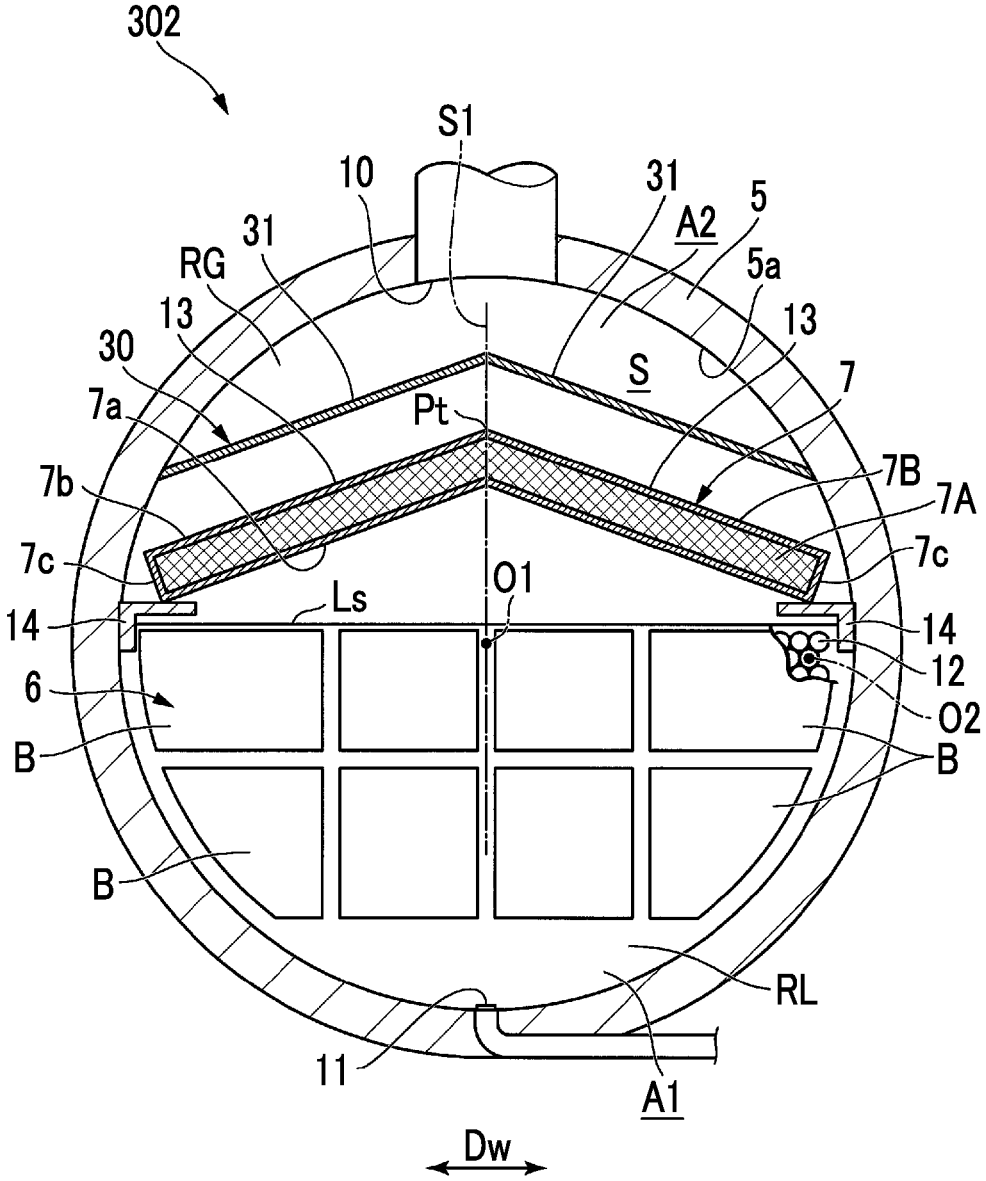
FIG. 6 is a sectional view intersecting an axis of a heat transfer tube of the evaporator according to the third embodiment of the present invention.

FIG. 5 is a perspective view illustrating an internal structure of the casing of an evaporator according to the third embodiment of the present invention. FIG. 6 is a sectional view intersecting the axis of the heat transfer tube of the evaporator according to the third embodiment of the present invention.

As illustrated in FIG. 5, an evaporator 302 according to the third embodiment includes the casing 5, the heat transfer tube bundle 6 (not illustrated), and the demister 7, as in the above-described first and second embodiments. The evaporator 302 according to the third embodiment further includes a blowing-up prevention plate 30.

The blowing-up prevention plate 30 prevents the droplet collected by the demister 7 from being suctioned into the evaporator outlet 10 from the outlet of the demister 7. The blowing-up prevention plate 30 is disposed at a position overlapping the evaporator outlet in the direction of the axis O1, that is, vertically below the evaporator outlet 10. The evaporator 302 in an example of FIG. 5 includes two blowing-up prevention plates 30, since two evaporator outlets 10 are disposed therein.

As illustrated in FIG. 6, the blowing-up prevention plate 30 is formed along the demister 7. More specifically, the blowing-up prevention plate 30 has two inclined plate portions 31, and the inclined plate portions 31 are respectively formed substantially parallel to the inclined portion 13 of the demister 7 (at substantially the same angle as the inclination angle of the inclined portion 13). That is, the blowing-up prevention plate 30 is formed in a mountain shape (in other words, an inverted V-shape). The inclined plate portions 31 are respectively disposed above the inclined portion 13 of the demister 7 at a predetermined interval. That is, distances between the demister 7 and the blowing-up prevention plate 30 in a vertical direction are substantially equal distances over an entire region of the casing 5 in the width direction Dw.

Therefore, according to the above-described third embodiment, the blowing-up prevention plate 30 is disposed at a position overlapping the evaporator outlet 10 in the direction of the axis O1. In this manner, the gas refrigerant RG passing through the demister 7 disposed at the position overlapping the evaporator outlet 10 in the direction of the axis O1 reaches the evaporator outlet 10 after bypassing the blowing-up prevention plate 30. Therefore, it is possible to prevent the droplets collected by the demister 7 disposed at the position overlapping the evaporator outlet 10 from being suctioned into the evaporator outlet 10.

Furthermore, the blowing-up prevention plate 30 is formed along the demister 7. Accordingly, a gap can be sufficiently secured between the demister 7 and the blowing-up prevention plate 30. Therefore, it is possible to prevent a partial increase in the flow rate of the gas refrigerant RG. In a case where the droplet adheres onto the blowing-up prevention plate 30, as in the droplet collected by the demister 7, the droplet can be dropped due to its own weight, and can be moved from directly below the evaporator outlet 10 by using the inclination of the inclined plate portion 31 of the blowing-up prevention plate 30. Therefore, the droplet can be further prevented from being suctioned into the evaporator outlet 10. A case has been described where the blowing-up prevention plate 30 includes the inclined plate portion 31 having a flat plate shape. However, a shape of the inclined plate portion 31 is not limited to the flat plate shape as long as the shape is formed along the inclined portion 13 of the demister 7.

Fourth Embodiment

Next, a fourth embodiment of the present invention will be described with reference to the drawings. The fourth embodiment is different from the above-described first to third embodiments in the heat transfer tube 12 is differently disposed in an evaporator. Therefore, the same reference numerals will be assigned to elements the same as those according to the above-described first to third embodiments, and repeated description will be omitted.

Figure 7:
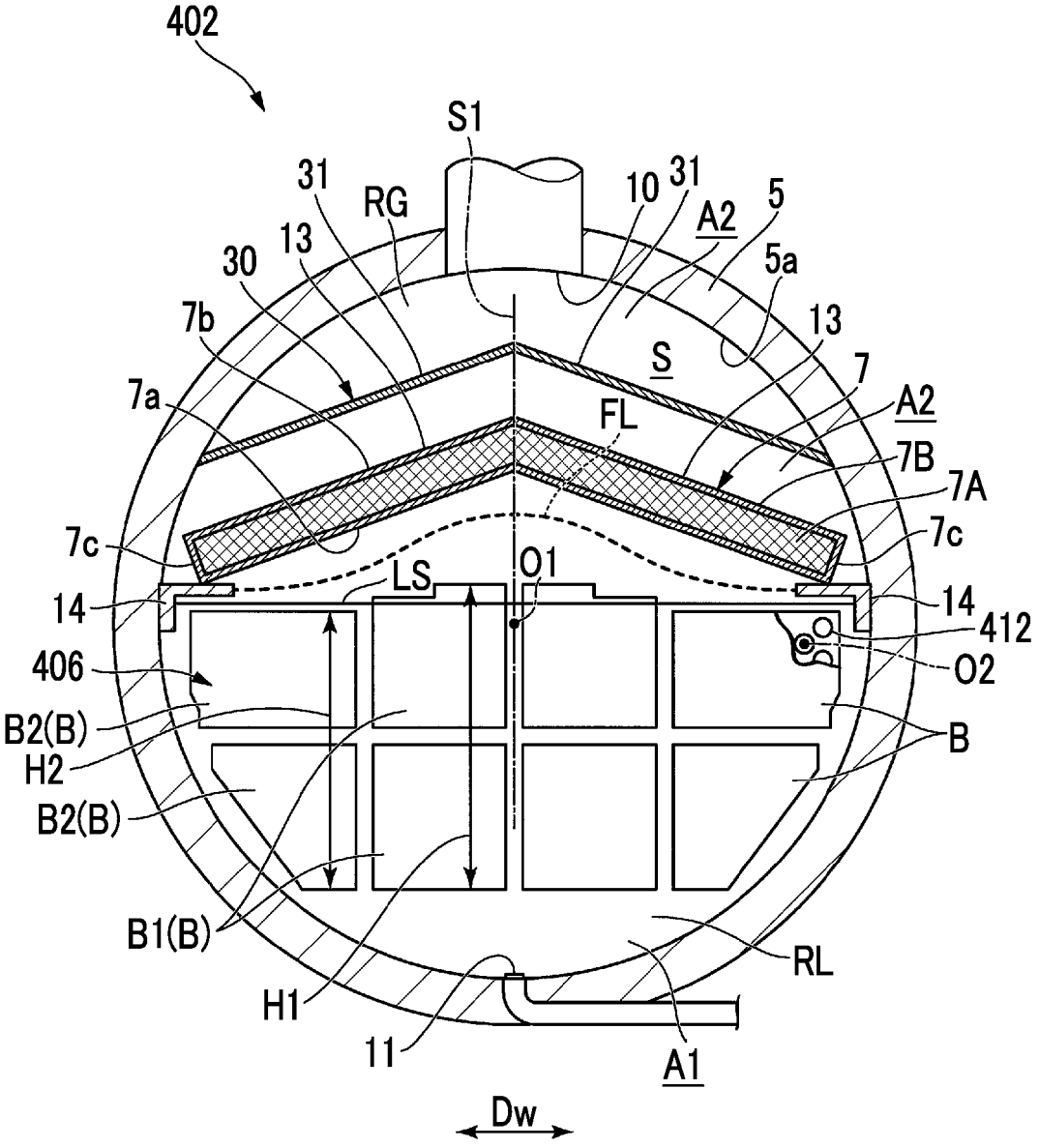
FIG. 7 is a sectional view of an evaporator corresponding to FIG. 2 according to a fourth embodiment of the present invention.

FIG. 7 is a sectional view of an evaporator corresponding to FIG. 2 according to the fourth embodiment of the present invention.

As illustrated in FIG. 7, an evaporator 402 according to the fourth embodiment includes the casing 5, a heat transfer tube bundle 406, the demister 7, and the blowing-up prevention plate 30. The blowing-up prevention plate 30 may be omitted. The casing 5 and the demister 7 have the same configurations as those of the above-described first to third embodiments, and thus, detailed description will be omitted.

As in the first embodiment, the heat transfer tube bundle 406 includes a plurality of heat transfer tubes 412 into which the cooling target fluid C flows. In a sectional view intersecting the axis O2 of the heat transfer tube 412, in the heat transfer tube bundle 406, the number of the heat transfer tubes 412 aligned in a direction intersecting the liquid surface Ls which are located at a position close to the central portion (hereinafter, simply referred to as a "position close to the center plane S1") of the casing 5 is larger than the number of heat transfer tubes 412 which are located at a position close to an end portion of the casing 5 (hereinafter, simply referred to as a "position close to both side portions in the width direction Dw of the casing 5") in a spreading direction of the liquid surface Ls.

The heat transfer tube bundle 406 described as an example in the fourth embodiment is divided into a plurality of blocks B in the width direction Dw of the casing 5 as in the first embodiment. In a sectional view illustrated in FIG. 7, the plurality of blocks B are arranged in the width direction Dw with a slight gap therebetween. In the heat transfer tube bundle 406 described as an example in the fourth embodiment, four blocks B are arranged in the width direction Dw. A total height H1 of the two blocks B1 disposed at the position close to the center plane S1 is higher than a height H2 of the two blocks B2 disposed at the position close to both side portions in the width direction Dw of the casing 5.

In other words, the total height H2 of the two blocks B2 disposed at the position close to both side portions in the width direction Dw of the casing 5 is decreased, and the total height H1 of the two blocks B1 disposed at the position close to the center plane S1 is increased. In this way, the number of the heat transfer tubes 412 aligned in the direction intersecting the liquid surface Ls at the position close to the center plane S1 is larger than the number of the heat transfer tubes 412 at the position close to both side portions in the width direction Dw of the casing 5 in the spreading direction of the liquid surface Ls.

Therefore, according to the above-described fourth embodiment, it is possible to minimize the number of heat transfer tubes 412 disposed at the position close to both side portions in the width direction Dw of the casing 5. Accordingly, it is possible to prevent a rise of the froth level FL at the position close to both side portions in the width direction Dw of the casing 5. Therefore, it is possible to prevent the end edge 7*c* of the demister 7 from sinking into the liquid refrigerant RL due to the rise of the froth level FL. On the other hand, even if the froth level FL rises at the position close to the center plane S1, the demister 7 is disposed separately from the liquid surface Ls. Accordingly, it is possible to prevent the demister 7 from sinking into the liquid refrigerant RL.

In the above-described fourth embodiment, a case has been described in which the total height H1 of the blocks B1 aligned in an upward-downward direction is higher than the total height H2 of the blocks B2 aligned in the upward-downward direction. However, the installation number of the heat transfer tubes 412 per unit area (in other words, density of the disposed heat transfer tubes 412) may be changed to decrease the number of the heat transfer tubes 412 at the position close to both side portions in the width direction Dw of the casing 5. In this manner, the number of the heat transfer tubes 412 at the position close to the center plane S1 may be increased. In addition, in the above-described fourth embodiment, a case has been described where the four blocks of the heat transfer tube bundle 406 are arranged in the spreading direction of the liquid surface Ls, in a sectional view intersecting the axis O2 of the heat transfer tube 412. However, the disposition of the blocks B is not limited to the disposition described as an example in the fourth embodiment.

The present invention is not limited to the configurations of the above-described respective embodiments, and design can be changed within the scope not departing from the gist of the present invention.

For example, in the above-described respective embodiments, a case has been described where the inclined portion 13 of the demister 7 is formed in a flat plate shape. However, for example, the inclined portion 13 may be formed in an arc shape that projects upward or downward in a cross section intersecting the axis O2.

In addition, in the above-described respective embodiments, a case has been described where the vertex position Pt of the demister 7 is disposed on the center plane S1 in the width direction Dw of the casing 5. However, the present invention is not limited to the case where the vertex positions Pt is disposed on the center plane S1. For example, the vertex position Pt may be shifted from the center plane S1 within a range where the rise of the froth level FL can be avoided. In addition, a case where the two inclined portions 13 form a corner portion at the vertex position Pt has been described as an example. However, for example, a shape may be adopted in which the corner portion is chamfered using a curved surface, a flat surface, or a combination thereof.

Furthermore, a case has been described where the heat transfer tube bundle 6 in the above-described embodiments is disposed in the liquid phase region A1 below the liquid surface Ls. However, the heat transfer tube bundle 6 may be disposed below the froth level FL.

In addition, in the above-described respective embodiments, a case where the refrigeration system 100 includes the turbo compressor 1 has been described as an example. However, the refrigeration system 100 may include other compressors, in addition to the turbo compressor 1.

INDUSTRIAL APPLICABILITY

According to the evaporator and the refrigeration system, downsizing or an increase in a heat exchange amount can be achieved while preventing a carryover phenomenon.

REFERENCE SIGNS LIST

1: turbo compressor
2, 202, 302, 402: evaporator
3: expansion valve
4: condenser
5: casing
5*a*: inner surface
6, 406: heat transfer tube bundle
7: demister
7A: demister main body
7B: frame
7*a*: inlet
7*b*: outlet
7*c*: end edge
10: evaporator outlet
11: evaporator inlet
12, 412: heat transfer tube
13: inclined portion
14, 214: support portion
14*a*, 214*a*: support portion main body
14*au*, 214*au*: upper surface
14*b*: fixing portion

20: penetrating portion
30: blowing-up prevention plate
31: inclined plate portion
100: refrigeration system
A1: liquid phase region
A2: gas phase region
B, B1, B2: block
C: cooling target fluid
Dw: width direction
FL: froth level
H1, H2: height
h: slit
Ls: liquid surface
O1, O2: axis
Pt: vertex position
RG: gas refrigerant
RL: liquid refrigerant
S: internal space
S1: center plane
W: cooling water

The invention claimed is:

1. An evaporator comprising:

a casing that internally has a liquid phase region for accommodating a liquid refrigerant and a gas phase region for accommodating a gas refrigerant obtained after the liquid refrigerant evaporates, and that includes an evaporator outlet for discharging the gas refrigerant to the gas phase region;

a plurality of heat transfer tubes that are immersed in the liquid refrigerant of the liquid phase region, and into which a fluid having a temperature higher than that of the liquid refrigerant flows; and a demister that is disposed to cover a liquid surface of the liquid refrigerant accommodated in the liquid phase region from above, and that collects a droplet contained in the evaporated gas refrigerant, wherein the demister formed in a mountain shape includes two inclined portions that separate from the liquid surface toward a central portion of the casing along the liquid surface, in a sectional view intersecting an axis of the heat transfer tube, wherein the casing includes two support portions that support an end edge of the demister on a side close to the liquid surface from below, and wherein the support portion includes a support portion main body that extends toward the center from the inner surface of the casing above the liquid level and on both side positions in the width direction of the casing, and a fixing portion that extends downward from a base portion of the support portion main body along the inner surface of the casing, wherein the support portion main body includes a penetrating portion that vertically penetrates between the end edge and an inner surface of the casing, in the sectional view intersecting the axis of the heat transfer tube.

2. The evaporator according to claim 1, further comprising:

a blowing-up prevention plate that is formed along the demister, in the sectional view intersecting the axis of the heat transfer tube, and that is disposed at a position overlapping the evaporator outlet in a direction of the axis.

3. The evaporator according to claim 1, wherein in the sectional view intersecting the axis of the heat transfer tube, the number of the heat transfer tubes aligned in a direction intersecting the liquid surface which are located at a position close to the central portion is larger than the number of heat transfer tubes which are located at a position close to an end portion of the casing in a spreading direction of the liquid surface.

4. The evaporator according to claim 2, wherein in the sectional view intersecting the axis of the heat transfer tube, the number of the heat transfer tubes aligned in a direction intersecting the liquid surface which are located at a position close to the central portion is larger than the number of heat transfer tubes which are located at a position close to an end portion of the casing in a spreading direction of the liquid surface.

5. A refrigeration system comprising:

the evaporator according to claim 1.

* * * * *